United States Patent [19]

Spirk, Jr. et al.

[11] Patent Number: 4,692,587

[45] Date of Patent: Sep. 8, 1987

[54] HAND TOOL AND SUPPORT

[76] Inventors: John W. Spirk, Jr., 50 Stonewood Dr.; John R. Nottingham, 60 Stonewood Dr., both of Moreland Hills, Ohio 44022

[21] Appl. No.: 831,720

[22] Filed: Feb. 19, 1986

[51] Int. Cl.[4] ..... H05B 3/42

[52] U.S. Cl. ..... 219/242; 222/173; 222/180; 219/247; 219/259

[58] Field of Search ..... 219/242, 229, 230, 247, 219/259; 211/70.6, 40, 41; 228/51-55, 57; 248/176, 346; 222/79, 180, 173

[56] References Cited

U.S. PATENT DOCUMENTS

| | | | |
|---|---|---|---|
| D. 234,905 | 4/1975 | Foster et al. | D8/71 |
| D. 255,771 | 7/1980 | Cruz | D8/71 |
| 723,634 | 3/1903 | Ayer | 219/231 |
| 905,459 | 12/1908 | Rice | 219/247 X |
| 925,050 | 6/1909 | Sprenger | 219/231 |
| 1,554,347 | 9/1925 | Hansen et al. | 219/259 |
| 1,655,708 | 1/1928 | Moyer | 219/259 |
| 2,020,110 | 11/1935 | Duvall | 219/247 |
| 2,058,068 | 10/1936 | Duvall | 219/247 |
| 2,454,875 | 11/1948 | Hyde | 226/128 |
| 2,556,609 | 6/1951 | Arkless | 219/227 |
| 2,681,685 | 6/1952 | Arkless | 219/227 |
| 2,952,763 | 9/1960 | Gustafsson | 219/229 |
| 2,995,159 | 8/1961 | Berggren | 219/229 |
| 3,002,077 | 9/1961 | Caliri | 219/229 |
| 3,141,087 | 7/1964 | Schoenwald | 219/229 |
| 3,141,956 | 7/1964 | Schoenwald | 219/229 |
| 3,204,828 | 9/1965 | Paulsen | 219/227 |
| 3,281,576 | 10/1966 | Cooper et al. | 219/227 |
| 3,314,574 | 4/1967 | Longval et al. | 219/227 |
| 3,316,385 | 4/1967 | Anton | 219/229 |
| 3,413,742 | 12/1968 | Sueur et al. | 219/242 X |
| 3,443,059 | 5/1969 | Spencer | 219/233 |
| 3,459,335 | 8/1969 | Cohen et al. | 219/227 |
| 3,531,038 | 9/1970 | Dezzani | 219/229 |
| 3,543,968 | 12/1970 | Reighard et al. | 219/229 |
| 3,707,258 | 12/1972 | Schlitt | 219/229 |
| 3,760,149 | 9/1973 | Harsanyi | 219/247 |
| 3,899,654 | 8/1975 | Walton | 219/229 |
| 3,924,097 | 12/1975 | Knowles et al. | 219/242 |
| 4,045,651 | 8/1977 | Koo | 219/229 |
| 4,199,082 | 4/1980 | Ornsteen | 222/146.5 |
| 4,245,759 | 1/1981 | Baker et al. | 219/230 |
| 4,333,623 | 6/1982 | May | 248/176 |
| 4,358,661 | 11/1982 | Kaderabek | 228/51 X |
| 4,379,516 | 4/1983 | Barlogis | 222/146 HE |
| 4,456,816 | 6/1984 | Fortune | 219/242 |

*Primary Examiner*—J. R. Scott
*Assistant Examiner*—A. Jonathan Wysocki
*Attorney, Agent, or Firm*—Renner, Otto, Boisselle & Lyon

[57] ABSTRACT

A hand tool (implement) such as a glue gun and a support for the hand tool. The support is designed for engaging the hand tool and supporting the hand tool in a manner that enables the hand tool to be conveniently removed therefrom. In the preferred embodiment, the support comprises an upstanding post adapted to engage a first portion of the hand tool. The support includes a special lever which is adapted to exert a prying force upon the first portion of the tool to disengage the tool from the upstanding post. The construction of the tool and the support allows the user to readily disengage and remove the hand tool from the support with a single hand simply by grasping the tool and imparting a slight rocking or rotational force thereto. The tool and support are particularly useful in constructing a cordless glue gun that is electrically energized while on the support and which is conveniently detached from the support and from the source of electricity.

34 Claims, 15 Drawing Figures

HAND TOOL AND SUPPORT

INTRODUCTION

This invention relates to a hand tool (implement) such as an adhesive applicator (glue gun), and to a support for releasably supporting the hand tool. More specifically, this invention relates to a structure which enables a hand tool such as a glue gun to be firmly maintained on a support, and to be conveniently removed from the support. This invention is particularly useful in constructing a cordless glue gun or similar article which is electrically energized (heated) while it is on the support and which is conveniently detached from the support and from its source of electricity when it is used to apply adhesive to an object.

BACKGROUND

A hot melt adhesive applicator (glue gun) of a known construction is designed to be connected to a wall socket by an electrical cord and plug for continuously applying electrical power to the gun to melt the adhesive in the gun. This means that the range over which the glue gun may physically operate is determined by the length of the electrical cord coupling the glue gun to the wall socket. Moreover, the cord at times presents a physical obstacle for a user to have to maneuver around when using the glue gun. The foregoing problems make a cordless glue gun i.e., a glue gun that can detach from its source of electricity, so it can operate without an electrical cord, particularly attractive.

The applicants have designed a cordless glue gun. In designing the cordless glue gun, the applicants have also found that significant attention needs to be paid to the support structure for the glue gun. The support structure has to be able to conveniently support the glue gun, and in a manner that enables the glue gun to be electrically energized (heated) while it is on the support structure. Moreover, the support structure and the glue gun need to be designed to enable convenient release of the glue gun from the support and from the source of electricity when it is desired to use the glue gun.

Still further, in designing a cordless glue gun, the applicants have found that the principles for supporting a glue gun according to this invention can also be applied to other types of hand tools or implements, e.g., soldering irons, stapling guns, hair dryers, caulking guns, etc., where there is a need to conveniently support the hand tool, and to conveniently detach the hand tool from its support.

SUMMARY OF THE INVENTION

The present invention relates to a new and useful structure for supporting a hand held tool (implement) such as a glue gun or similar article, in a manner which allows the hand tool to be electrically heated while on a support, and which enables the hand tool to be conveniently disengaged from the support, preferably using only a single hand.

One aspect of the present invention relates to support structure for releasably securing a hand tool such as a glue gun or similar article. The support has a special release means for applying a force to the portion of a hand tool engaged with the support for conveniently disengaging the hand tool from the support.

The release means preferably comprises a special lever that exerts a prying force on a portion of a hand tool engaged with the support to release (disengage) the hand tool from the support. The lever is designed so that it can be pivoted in a predetermined manner relative to the support, to apply the prying force to the hand tool to release the hand tool from the support. With a support and a tool according to the preferred embodiment, the support can simply rest on a horizontal support surface, and the tool can cooperate with the lever in such a manner that a user can conveniently manipulate the tool with only one hand to cause the tool to pivot the lever to release the tool from the support.

In a significant aspect of the invention, the support includes a socket for transmitting electrical energy to the hand tool, and the release mechanism enables the tool to be disconnected from the socket while it is being released from the support. Thus, a hand tool such as a cordless glue gun can be electrically heated while on the support, and conveniently detached from the support and from the source of electrical energy for use in applying adhesive to an object.

The present invention is more fully described and particularly pointed out in the following detailed description and the annexed drawings.

DETAILED DESCRIPTION OF THE PREFERRED EMBODIMENT

As set forth above, the present invention relates to a hand tool (implement) and a support for the hand tool. It relates particularly to a hand tool such as an electrically energized hot melt adhesive applicator and a support with an electrical connector for the applicator. The principles of the invention are described below in connection with a hot melt adhesive applicator having the general shape (profile) of a gun, and referred to hereinafter as a "glue gun".

Figure 1:
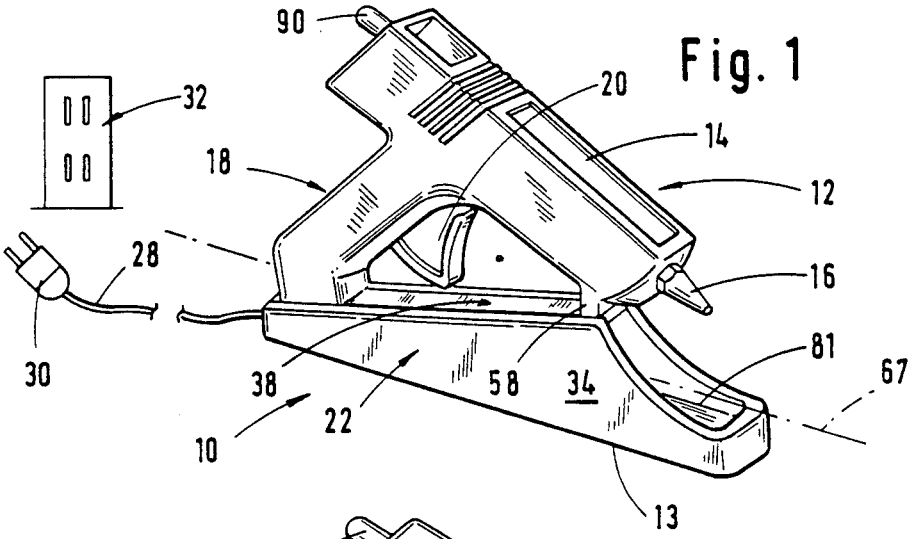
FIG. 1 is a three dimensional illustration of a hot melt adhesive applicator (glue gun) and support therefor, constructed according to the principles of this invention.
Figure 2:
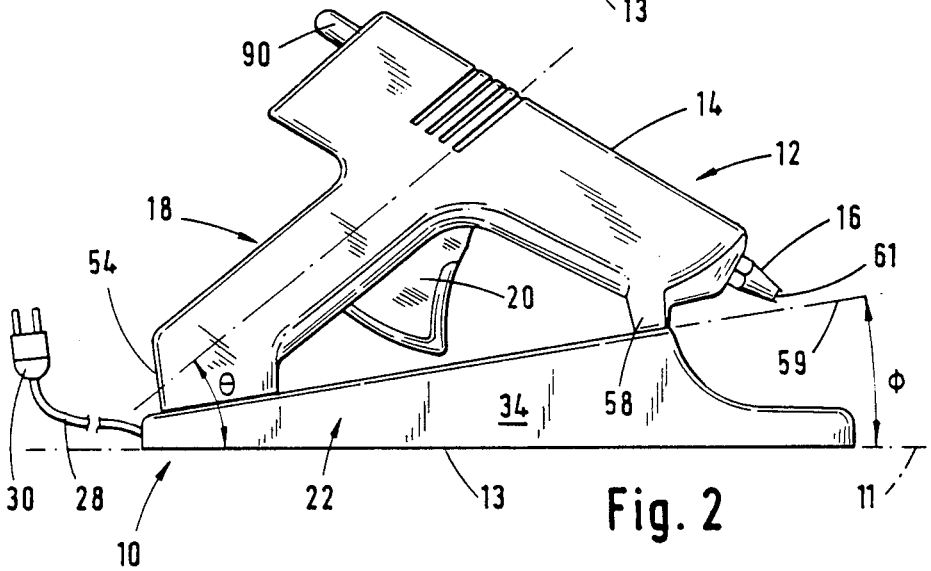
FIG. 2 is a side view of the glue gun and support of FIG. 1.
Figure 3:
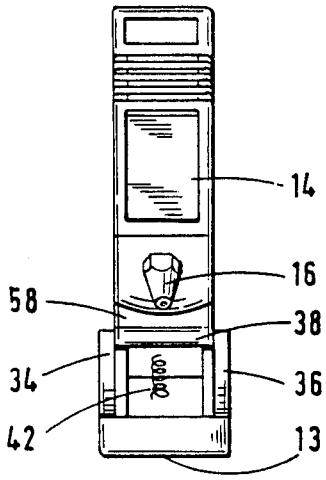
FIG. 3 is a front view of the glue gun and support of FIG. 1.
Figure 4:
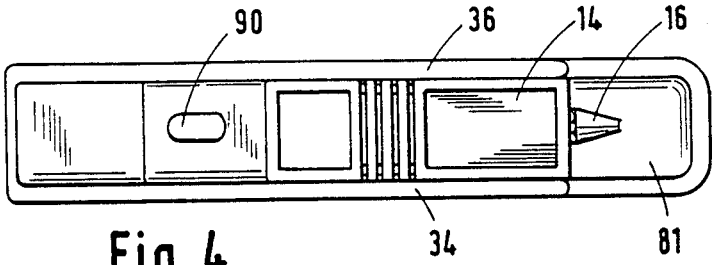
FIG. 4 is a top view of the glue gun and support of FIG. 1.
Figure 5:
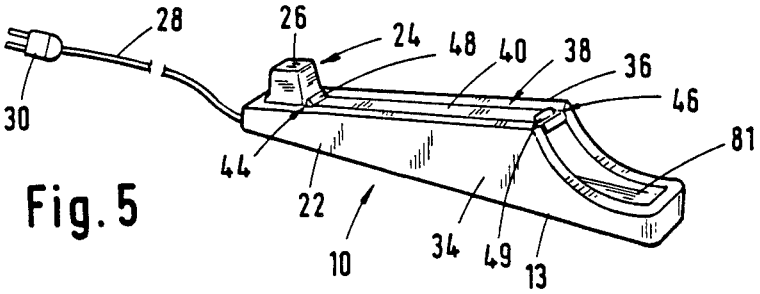
FIG. 5 is a three dimensional view of the support without the glue gun.
Figure 6:
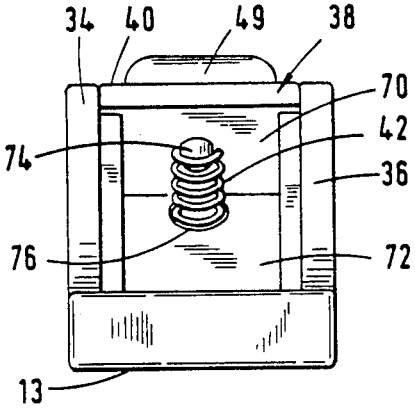
FIG. 6 is a front view of the support of FIG. 5.
Figure 7:
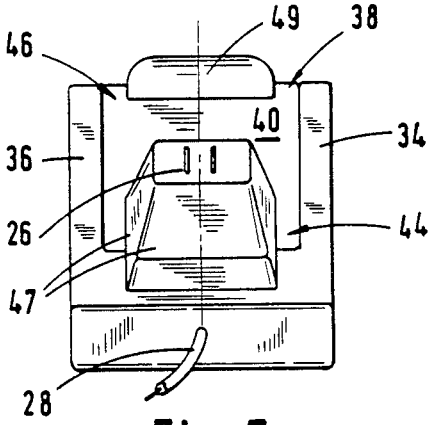
FIG. 7 is a rear view of the support of FIG. 5.
Figure 8:
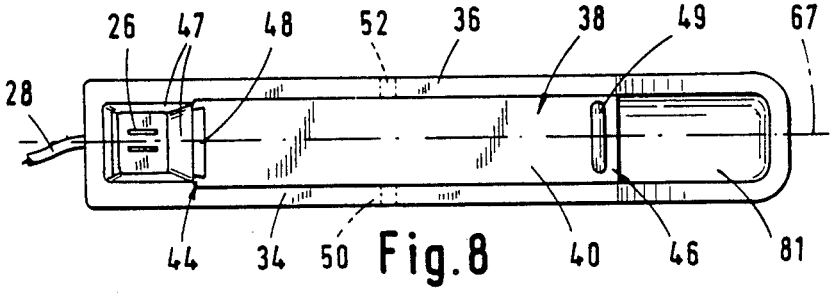
FIG. 8 is a top view of the support of FIG. 5.
Figure 9:
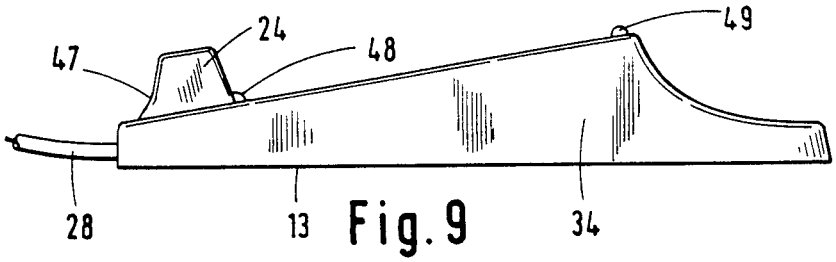
FIG. 9 is a side view of the support of FIG. 5.
Figure 10:
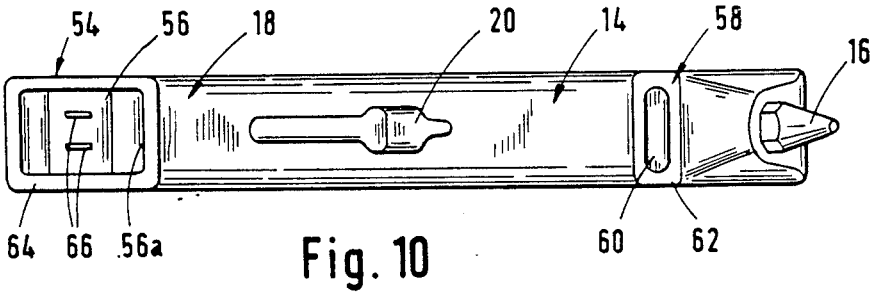
FIG. 10 is a view of the underside of the glue gun shown in FIG. 1.
Figure 11:
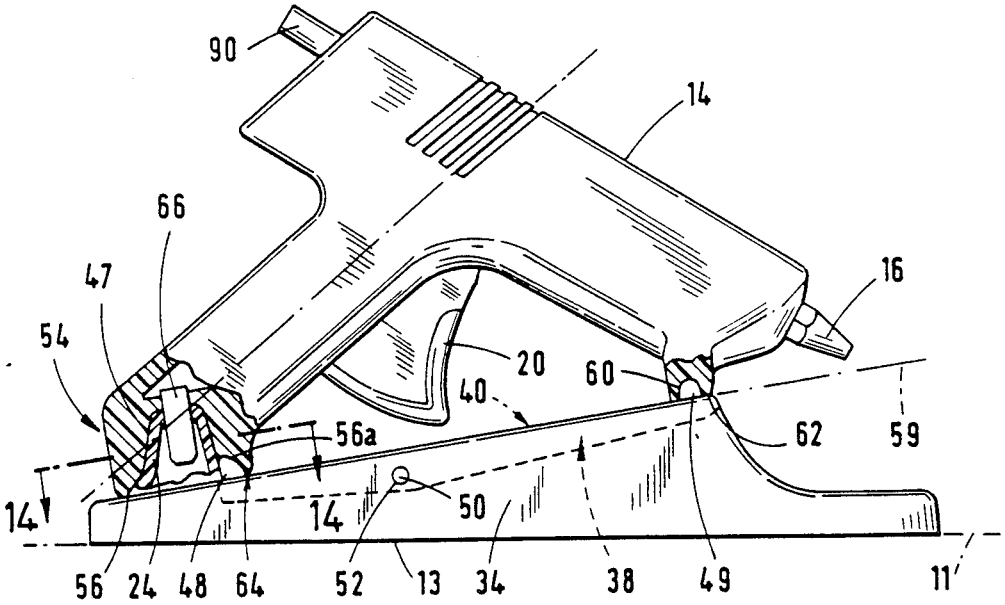
FIG. 11 is a schematic illustration of the glue gun located on the support, with portions of the glue gun and support broken away, and with portions omitted.

In the figures, a support 10 is provided for supporting an electrically energized glue gun 12 on a horizontal support surface illustrated schematically at 11 in FIGS. 2 and 11. The support 10 has a bottom wall 13 which rests on the horizontal support surface 11. In this application, reference to a support that "rests" on a support surface is intended to mean a support that is retained on the support surface only by gravitational/inertial forces (e.g., friction), and not by external or extrinsic anchoring or connecting means.

The glue gun 12 has a chamber portion 14 with a nozzle 16 for dispensing liquid adhesive. The glue gun 12 also has a handle 18 connected with the chamber portion 14, and designed to provide a convenient means for enabling a user to grip the glue gun. A trigger 20 is connected to the handle 18, and can be squeezed by a user in order to dispense liquid adhesive from the nozzle 16. The glue gun 12 and the support 10 are designed to facilitate one hand release of the glue gun 12 from the support 10 while the support rests on a horizontal support surface 11, as described more fully hereinafter.

The support 10 includes a frame 22 which includes the bottom wall 13. The frame 22 also includes a pair of side walls 34, 36, and an upstanding post 24 integral with one end of the frame 22. The post 24 is configured to extend in a slightly rearward orientation relative to the bottom wall 13 and to the support surface 11 (See FIG. 11). The post 24 includes an electrical socket 26, of conventional design, which is connected with a cord 28 extending out of the support 10. The cord 28 carries a conventional plug 30 for connection to an electrical outlet 32. Thus, the socket 26 in the support 10 is connected with a source of electrical energy by inserting the plug 30 into the outlet 32.

The walls 34, 36 extend angularly upward from the bottom of the post 24. A release lever 38 is pivotally connected with the walls 34, 36. The lever 38 has a substantially planar top surface 40 and the lever is biased by a spring 42 to an angularly upward orientation in which the top surface 40 of the lever 38 is substantially coplanar with the top surfaces of the walls 34, 36. The bottom end 44 of lever 38 is adjacent the bottom of the post 24. The top end 46 of lever 38 is adjacent the top of the walls 34, 36. When the support 10 rests on a support surface, the walls 34, 36 and the top surface 40 of the lever 38 preferably extend at an acute angle 0 to the bottom surface 13 and to the support surface 11 (See FIG. 2).

The post 24 preferably comprises a purality of walls 47 that converge slightly toward each other as they extend upwardly. The bottom end 44 of lever 38 carries an integral raised member 48 for purposes described more fully hereinafter. The top end 46 of lever 38 carries an integral, raised locating member 49, for purposes explained more fully hereinafter.

The lever 38 is pivotally connected to the walls 34, 36 by means of pivot pins 50 that are integral with the lever 38 and are pivotally received in respective recesses 52 in walls 34, 36. The profile of lever 38, and the bias of spring 42, normally urge the lever 38 to the position of FIGS. 2 and 11, where its top surface 40 is coplanar with the tops of walls 34, 36.

The chamber portion 14 of the glue gun 12 extends longitudinally, and the handle portion 18 of the glue gun 12 extends downwardly from the chamber portion 14 at an angle to the chamber portion 14. Also, the handle 18 preferably extends at an acute angle $\theta$ to the bottom surface 13 and to the support surface 11 (See FIG. 2). The bottom of the handle 18 has a bent portion 54 with a recessed portion 56 therein. The walls of the recessed portion 56 are designed to surround the walls 47 of the post 24 when the glue gun 12 is connected with the support 10. The lower part of the walls of the recessed portion 56 are flared outwardly, and one wall **56*a* is flared outwardly far enough so that the raised member 48 on the lever 38 can fit inside the recessed portion 56 when the glue gun 12 is connected with the support 10 and the lever 38 is in the position shown in FIG. 11**.

The chamber portion 14 of the glue gun 12 has a downwardly depending wall 58 near its front end. The wall 58, the chamber portion 14 and the handle 18 are all integral parts of the outer casing 79 of the gun 12, so that the wall 58 and the handle 18 are fixedly connected with each other. The wall 58 has a recess 60 in its underside for engaging the upstanding locating member 49 at the top end of lever 38. The wall 58 is also designed so that its bottom surface 62 is coplanar with the bottom surface 64 of the handle 18. The bottom surface 62 of the wall 58 and the bottom surface 64 of handle 18 define the lower most support points for the glue gun 12. As seen from FIG. 2, the surfaces 62, 64 are in the same reference plane (shown schematically at 59), and the dispensing tip 61 of nozzle 16 is disposed above the reference plane 59. Thus, when the glue gun 12 is detached from the support 10, the surfaces 62, 64 can support the glue gun 12 on a surface while maintaining the nozzle 16 away from (i.e., above) the surface.

Importantly, when support 10 rests on a support surface 11, and the glue gun 12 is connected with the support 10, the lever 38 extends at the acute angle $\phi$ to the support surface 11, the wall 58 extends at an angle to the lever 38, and the handle portion 18 extends at the acute angle $\theta$ to the support surface. As seen from FIG. 2, when support 10 rests on a horizontal support surface 11, and a user grasps handle 18 from above, there will be a natural downward force exerted on handle 18, and also a natural downward force exerted on the top end of lever 38 through the wall 58. The profile of the recessed portion 56 and the post 24 are preferably such that when the recessed portion 56 of the handle 18 is surrounding the upstanding post 24 and a downward force is applied to the handle 18, the handle 18 can rock or tilt slightly on the post 24 and enable the wall 58 to apply a downward force on the top end of the lever 38 and to pivot the lever 38 in the manner illustrated schematically in FIG. 12.

In connecting the glue gun 12 to the support 10, the recess 60 in wall 58 is initially inserted over the locating member 49 at the top end of the lever 38. The handle 18 of the glue gun 12 is then pivoted downward so that the recess 56 in the handle 18 is inserted over the post 24. As the handle 18 is urged downward over the post 24, a pair of connecting prongs 66 fixedly secured on the inside of the recess 56 are inserted into mating connectors 68 in the socket 26 to provide resilient, frictional engagement therewith and to establish electrical connection therewith. Also, if desired the walls of the recessed portion 56 may also provide a degree of frictional engagement with the walls 47 of the post 24. When the recessed portion is completely surrounding the post 24, the outwardly flared wall **56*a* at the bottom of the recessed portion 56 surrounds the raised portion 48 at the bottom end of the lever 38**.

The resilient, frictional engagement between prongs 66 and connectors 68, and the profiles of post 24 and recess 56, serve to retain the handle 18 on the support 10, and also allows some slight forward tilting (rocking) of the gun 12 when a downward force is applied to handle 18. The gun and the support 10 (including lever 38) preferably extend along a longitudinal reference plane 67, and reference to "forward" rocking or tilting means rocking or tilting along the longitudinal reference plane 67 and in a direction causing the front (nozzle bearing) end of the gun 12 to move downwardly from the position shown in FIGS. 2 and 11.

The configuration of the post 24 allows for an interference fit between the walls 47 of the post 24 and the walls of the recessed portion 56 when the handle 18 is fully depressed upon the post 24 (FIGS. 2 and 11). Such an interference fit between the recessed portion 56 and the post 24 would allow the support 10 to firmly hold and support the handle 18 of the gun 12 but also allow forward tilting (rocking) of handle 18 on post 24. Further, when the recessed portion 56 of the handle surrounds the post 47, the gun 12 is restrained from being inadvertently detached from the support 10 by the application of a rearward or lateral force.

In order to disengage the gun 12 from the support 10, the handle 18 is grasped by a user and rocked or tilted forward to cause the wall 58 to exert downward pressure on the top of the lever 38. As discussed above, the relative angular orientations of handle 18, lever 38 and wall 58, and the profiles of post 24 and recess 56, cause the natural action of grasping the handle 18 to apply forces to the gun 12 that rock or tilt the handle 18 forward and apply downward force to the top end of lever 38. Such force resolution also applies downwardly directed forces through the support 10 to its support surface 11, thereby stabilizing the support 10 when it is resting on a support surface, and avoiding the need for external or extrinsic connection between the support 10 and the support surface 11.

Figure 12:
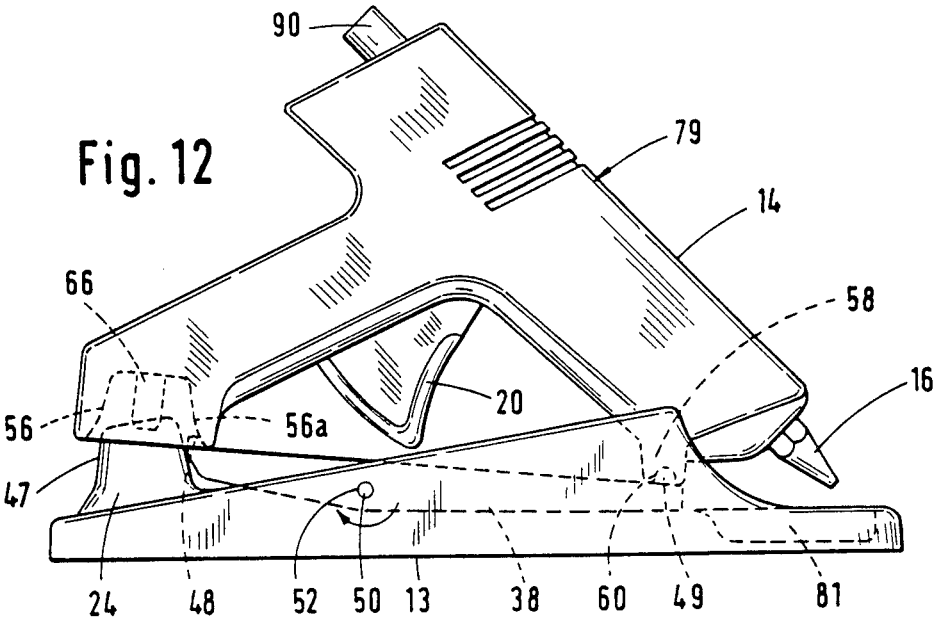
FIG. 12 is a schematic illustration of the glue gun and support, showing the manner in which the glue gun is released from the support.

As the handle 18 rocks forwardly, and downward pressure is applied to the top end of lever 38, the lever 38 begins to pivot in the direction illustrated in FIG. 12. As the lever 38 begins to pivot, the lower end 44 of the lever and the member 48 immediately begin to exert a prying force upon the walls of recess 56 in the handle 18. The prying force overcomes the frictional forces between the prongs 66 and the connector 68 of socket 26 and overcomes any friction between the walls of the post 24 and the walls of the recess 56, thereby disengaging the recess 56 from the post 24, disengaging the prongs 66 from the socket 26, and allowing for the convenient release (disengagement) of the gun 12 from the support 10.

The lever 38 is biased to the position of FIG. 11 by the spring 42 located beneath the lever 38. The spring 42 is preferably a helix coil spring that extends between the bottom surface 70 of the lever 38 and the top surface 72 of a wall fixed in the frame 22. The spring 42 is retained by a post 74 in the lever 38 and a recess 76 in the fixed wall. In the absence of a forward tilting force upon gun 12, the spring 42 holds the top surface 40 of the lever 38 parallel or flush with the top surfaces of sidewall portions 34 and 36. Thus, it holds the gun 12 in the position shown in FIGS. 2 and 11. When someone applies a forward tilting or rocking force to the gun 12, the spring 42 compresses and the lever 38 pivots in the manner described above. Although a coil spring 42 has been shown for biasing the lever 38, it will be appreciated that any one of a variety of springs may be utilized to bias the lever 38 to the position of FIG. 11.

In addition to the aforementioned, support 10 provides additional features. At the forward end of the support 10, below the upper portion of walls 34, 36, the frame 22 includes an integral trough 81 designed to collect and contain any uncontrolled glue discharged from nozzle 16. Also, the bottom wall 13 of the support 10 may be provided with a plurality of rubber feet (not shown) which further prevent sliding movement of the support 10 upon support surface 11 when the support 10 is resting on the support surface. If the support is provided with such rubber feet, the bottom surface 13 would extend parallel to and slightly above the support surface.

Figure 13:
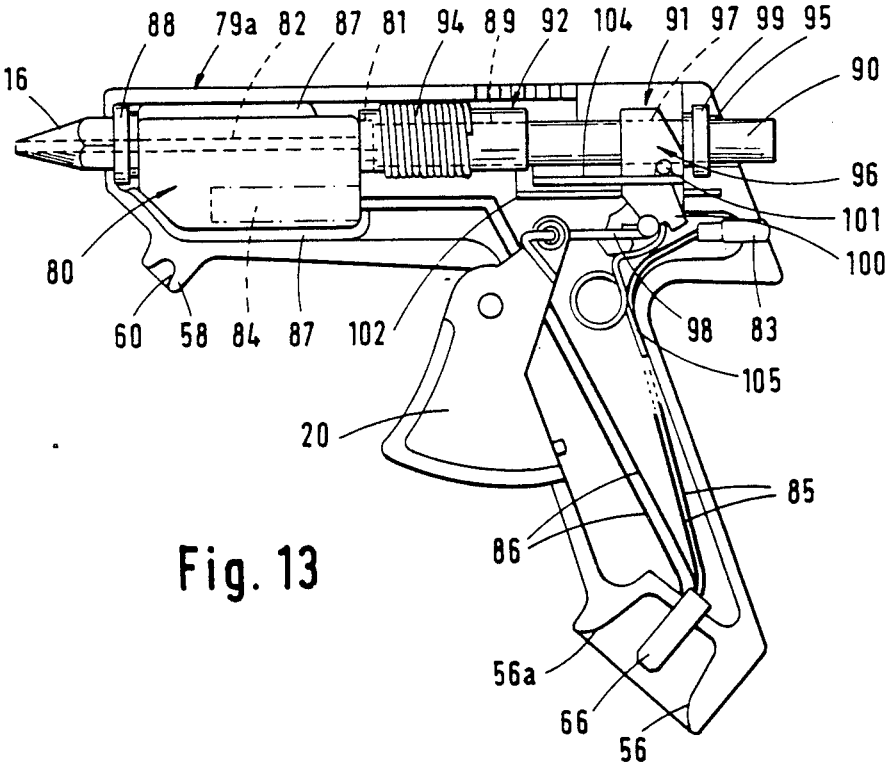
FIG. 13 is an illustration of the glue gun, with portions omitted, and showing the elements on the interior of the glue gun.

The outer casing 79 of the glue gun 12 comprises a pair of plastic sections **79*a* (FIG. 13 illustrates internal parts of one of the plastic sections). The internal elements of the glue gun 12 are also schematically illustrated in FIG. 13**.

Preferably, a die cast metal chamber 80 is connected with nozzle 16, and chamber 80 has an integrally formed internal passage 82 for hot melt adhesive in a liquid (viscous) state. The term "hot melt" adhesive preferably means an adhesive sold commercially in a stick-like form and in highly viscous (solid-like) state, and which "melts" or changes to a "liquid" (less viscous) state when subjected to a predetermined temperature.

A resistance heating element 84 is disposed in contact with the walls of chamber 80, and is electrically connected with the prongs 66 via a pair of leads 86. Thus, when electrical energy is applied to prongs 66, the resistance heater 10 heats the walls of the chamber 80, which in turn heat the internal passage 82. While the chamber 80 is heating, an indicator lamp 83 is illuminated, via leads 85 which extend from the prongs 66, in parallel with leads 86.

Preferably, the outer casing 79 is molded of a plastic with good heat insulating (resisting) characteristics. For example, in a glue gun designed for high temperature stability to at least 310° F., a General Electric plastic sold under the mark "Valox®" appears to be suitable. The chamber 80 is insulated from the outer casing of the gun by a high temperature insulation 87 which surrounds the chamber 80 and a high temperature washer 88 supported on the inside of the plastic casing of gun 12. For a glue gun with stability to at least 310° F., it is believed that the insulation 87 can be of a type sold by The Carborundum Company, Niagara Falls, N.Y., under the mark "Fiberfrax®", and the washer 88 may be made from the same Valox® material used to form the outer casing 79.

The hot melt adhesive, in the form of a glue stick 90, is communicated with heating chamber 80 through an advance mechanism 91 and a flexible tube-like member 92 which is secured about a collar 81 integral with the heating chamber 80. The glue stick 90 is moved forward by the advance mechanism 91 and is melted as it contacts the walls of the heating chamber 80.

The flexible member 92 is preferably formed of a heat resistant polymer that has a high temperature stability to at least 310° F. There are heat resistant silicone rubbers made by several manufacturers (e.g., General Electric, Dow Corning) that are believed suitable for forming the flexible member 92. The flexible member 92 has an internal passage 89 for the glue stick 90, and the flexible member 92 is contained by a coil spring 94. The coil spring 94 allows some radial expansion of the flexible member 92 but prevents excessive radial expansion of the flexible member 92 when the advance mechanism 91 is exerting a forward force upon the glue stick 90. The coil spring 44 is retained in position in the casing by walls (not shown) formed in the plastic casing sections.

The advance mechanism 91 comprises an actuator member 96 which is provided with an opening 97 to allow the glue stick 90 to pass therethrough. The casing 79 also has a rear opening 95 and a rear ring or washer 99 through which the glue stick can pass. The rear ring or washer 99 can be made of the same flexible material (e.g. silicone rubber) used to form the flexible member 92.

The actuator member 96 is attached to trigger 20 by an intermediate member 100 which pivotally supports the actuator member 96 (via pivot member 101), and a connecting rod 98 which couples the intermediate member 100 to the trigger 20. When the actuator member 96 is urged forwardly (i.e., toward nozzle 16), the actuator member 96 can cock slightly (about the pivot member 101), but is otherwise restricted to linear movement by a slide member on the actuator member and a guide surface on the casing 79 in FIG. 13 (part of the guide surface on the casing being shown schematically at 102 and part of the slide member on the actuator member 96 is shown schematically at 104).

When the trigger 20 is squeezed by a user, the trigger 20 pivots in the casing, and causes a force to be exerted on actuator member 96. The actuator member 96 will cock slightly causing it to engage the glue stick 90, and will force the glue stick 90 forwardly within the flexible member 92. The glue stick 90 is forced against and into the chamber 80 and is melted by the chamber, causing liquid glue to be forced out of the nozzle 16. The diameter of the glue stick 90, and the diameter of the passage 89 in the member 92 are preferably greater than the diameter of the passage 82 in the heating chamber 80. Although not shown, the inner end of passage 82 (adjacent flexible member 92) can be funnel shaped to enable convenient passage of adhesive from flexible member 92 and into the passage 82. The ability of the flexible member 92 to expand somewhat radially, and the difference in diameters of the glue stick 90 and the passage 82 enables a ready supply of adhesive to normally reside at the inner end of the passage 82 when the trigger 20 is squeezed. Upon release of the trigger 20, a spring 105 causes the trigger 20 to return to its original position and the actuator member 96 slides linearly backward along the glue stick 90.

When the gun 12 is connected with the support 10 in the manner described above, the electrical coupling between the prongs 66 and the connectors 68 of socket 26 causes the chamber 80 to heat (and illuminates the indicator lamp 83). The spring 42 biases the lever 38 to the position shown in FIG. 11. The handle 18 of the gun 12 engages the post 24, and the recess 60 of the wall 58 at the front end of the gun 12 engages the locating member 49 at the upper end of the lever 38. The dispensing nozzle 16 on the gun 12 extends forwardly over the trough 81, so that any material that may drip from the dispensing nozzle 16 is caught by the trough.

The glue gun 12 can be conveniently detached from the support and can be electrically disconnected from the support by the use of only a single hand. More specifically, as a user grasps the handle 18 of the gun 12, and exerts a slight downward force on the handle, the handle 18 (and the gun) will rock or tilt slightly in a forward manner. The wall 58 at the front end of the gun 12 will be urged downward, causing the lever 38 to begin to pivot in the clockwise direction shown in FIG. 12. As the lever 38 begins to pivot, the lower end 44 of the lever 38 immediately exerts a prying action on the inside of the walls of recess 56, forcing the handle 18 upward and off the post 24 in the manner illustrated in FIG. 12. The prying action of the lever overcomes the frictional engagement between the prongs 66 and the contacts 68 of socket 26, and any frictional engagement between the recess 56 and the post 24 in order to disengage the handle 18 of the gun 12 from the support 10. When the gun 12 has been disengaged from the support 10, the gun 12 can dispense liquid adhesive for a period of time, because the chamber 80 acts as a heat sink for applying heat to melt the adhesive for a period of time. The insulating material 87 around the chamber 80 also contributes to the chamber retaining heat for a period of time.

Thus, as seen from the foregoing description, by pivoting the lever 38 in a predetermined manner relative to the support 10, the lever 38 exerts a prying action on the handle 18 of the gun 12 for detaching the gun 12 from the support 10. This provides a convenient one hand release of the gun 12. Even more significantly, with the foregoing structure of the gun 12 and the support 10, the resolution of forces through the handle 18 and to the lever 38 and the support 10 enables one hand release to be effected while the support 10 is simply resting on a horizontal support surface, without the need for any additional fixation of the support 10 to its support surface. Thus, the support 10 can simply rest on a horizontal support surface without being fixed to the support surface, and the gun 12 can be easily released with a one hand operation in the manner described.

The essential elements of the support 10, i.e., the lever 38 and the frame 22 are preferably plastic members that can be injection molded. Also, as discussed above, the outer casing members **79*a*** of the glue gun are also preferably molded of plastic. To provide temperature stability to at least 310° F., plastic such as the General Electric Valox ® discussed above is preferred for all of the foregoing plastic parts.

Figure 14:
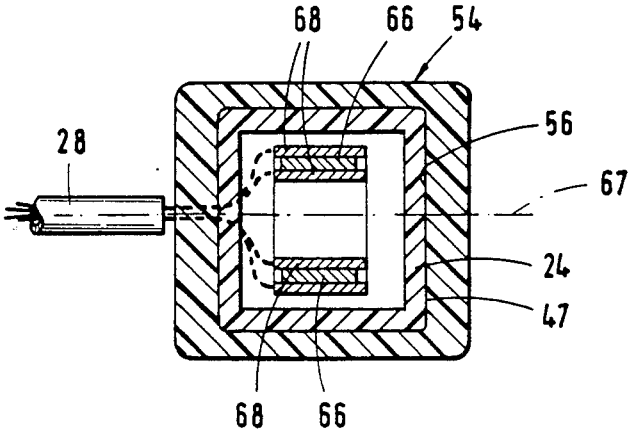
FIG. 14 is a sectional view of the structure of FIG. 11, taken along the line 14—14.
Figure 15:
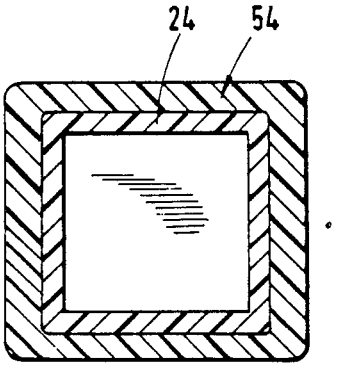
FIG. 15 is a sectional view similar to FIG. 14, but showing a modified form of coupling between the glue gun and the support.

As illustrated in FIG. 14, the frictional engagement between the handle 18 and the post 24 may be provided primarily by the prongs 66 that frictionally engage the contacts 68 of the socket in the post 24. However, it is also contemplated that the principles of the present invention may be applicable to construct supports and tools (implements) connected by other forms of frictional engagement. For example, the frictional engagement could be exclusively between the recess 56 in the handle 18 and the outer walls 47 of the post 24, particularly where there is no electrical connection of the tool to a source of electricity. Such type of frictional engagement is schematically illustrated in FIG. 15, and would be another type of engagement that can be frictionally overcome by the release means described above.

Additionally, with the concepts of the invention, it is believed that support for various types of hand tools or implements (e.g., soldering guns, caulking guns, staple guns, hair dryers etc.) can also be designed to embody the foregoing principles. In addition, while the preferred embodiment is designed for a support that rests on a horizontal support surface, without the need for additional connection, it is also possible to connect the support to a vertical wall if desired. In this application, reference to "upstanding" or "angularly" is intended to encompass something that extends in an upstanding or angular fashion relative to (i) the bottom surface 13 of the support or (ii) the support surface upon which the support is mounted.

As part of this disclosure, herewith are some photocopies of photographs showing features of the invention described above.

Although the invention has been shown and described with respect to a certain preferred embodiment, it is obvious that equivalent alterations and modification will occur to others skilled in the art upon the reading and understanding of this specification. The present invention includes all such equivalent alterations and modifications, and is limited only by the scope of the following claims.

What is claimed:

1. A support for releasably securing a hand tool thereto, comprising a post having means for engaging a portion of a hand tool thereon, and releasing means for applying a force to the portion of a hand tool engaged with said post for disengaging the portion of the hand tool from said post, said releasing means comprising a lever having a first end disposed adjacent said post, and said lever being pivotally mounted in a manner that enables said first end to exert a prying force on a portion of the hand tool engaged with said post.

2. A support as set forth in claim 1 wherein said post comprises upstanding wall means, and said lever is pivotally mounted in a manner that enables said first end to exert a prying force against a portion of a hand tool surrounding said upstanding wall means.

3. A support as set forth in claim 2 comprising a frame having a lower part and an upper part, said upstanding wall means of said post being integral with said frame and extending upward from the lower part of said frame, said lever being biased to a position in which its first end is disposed at the lower part of said frame and said lever being pivotal in a release direction that moves its first end in an upward direction relative to the lower part of said frame to exert said prying force against a portion of a hand tool surrounding said upstanding wall means of said post.

4. A support as set forth in claim 3 wherein said lever includes a substantially planar top surface, said first end of said lever including an integral member extending upward from said top surface and adapted to engage a portion of a tool surrounding said upstanding wall means of said post to exert a prying force thereagainst when said lever is pivoted in said release direction.

5. A support as set forth in claim 4 wherein the lever has a second end disposed to move in a predetermined manner relative to a selected portion of said frame to pivot said lever in said release direction to cause said first end of the lever to exert a prying force on a portion of the hand tool surrounding said upstanding wall means of said post.

6. A support as set forth in claim 5 wherein said second end of said lever comprises an integral locating member extending upward from said top surface of said lever for engaging a part of a hand tool for enabling the part of the hand tool to exert a force on said second end of said lever to move said second end of said lever in said predetermined manner.

7. A support as set forth in claim 6 wherein the upper end of said post includes an electrical socket, and further including electrical connector means for connecting said electrical socket to a source of electricity.

8. A support as set forth in claim 5 wherein said frame has wall portions that extend angularly upward from the lower part of the frame to the upper part, and said lever extends angularly upward from its first end to its second end, said lever being biased to a position in which its top surface is substantially coplanar with the upper surfaces of the wall portions of said frame, said second end of said lever being pivotal downward relative to the upper part of the frame to pivot the first end of the lever upward relative to the post to exert a prying force on a portion of a hand tool surrounding said wall means of said post.

9. A support as set forth in claim 8 wherein said second end of said lever includes an integral locating member extending upward from said top surface of the lever for engaging a part of a hand tool for enabling the part of the hand tool to exert a force on said second end of said lever to pivot said second end of said lever in said predetermined manner.

10. A support as set forth in claim 9 wherein said post includes an electrical socket, and said support further includes electrical connector means for connecting said electrical socket to a source of electricity.

11. A support as set forth in claim 8 further including trough means to collect products of discharge from a hand tool engaged with said support, said trough means being integral with said frame and being disposed below the upper part of the frame and forwardly of the upper part of the frame.

12. A support as set forth in claim 3 wherein said frame comprises an integral molded piece of plastic, and said lever comprises an integral molded piece of plastic.

13. Apparatus comprising a hand tool and a support for releasably supporting said hand tool, said support having means for engaging a first portion of the tool and release means actuated by predetermined movement of a second portion of said tool relative to said support for applying a force to said first portion of the tool for disengaging said first portion of said tool from said support, said means for engaging said first portion of said tool comprising a post connected with said support, said post including means for frictionally engaging said first portion of said tool, said release means comprising a lever pivotally connected to said support, and said lever being disposed such that when said predetermined movement of said second portion of said tool occurs the lever pivots and a portion of said lever imparts a prying force upon said first portion of said tool in a direction which overcomes the frictional engagement between said first portion and said means for frictionally engaging to disengage said first portion of said tool from said post.

14. Apparatus as set forth in claim 12 wherein said lever has a first end having means for engaging said first portion of said tool and a second end which is engaged by said second portion of said tool to cause said lever to pivot when said second portion of said tool makes said predetermined movement relative to said support.

15. Apparatus as set forth in claim 14 wherein said first portion of said hand tool includes a recessed portion adapted to surround said upstanding post, and said first end of said lever being adapted to exert said prying force against the part of said recessed portion surrounding said post to pry said first portion of said hand tool off said post.

16. Apparatus as set forth in claim 15 including locating means at said second end of said lever for engaging said second portion of said hand tool for locating said second portion of said hand tool in a predetermined position relative to said lever when said second portion of said tool makes said predetermined movement relative to said support.

17. Apparatus as set forth in claim 16 wherein said second portion of said tool includes a support wall having a locating recess and said locating means includes a locating member on said lever receivable in said locating recess in said support wall.

18. Apparatus as set forth in claim 17 wherein said upstanding post includes an electrical socket and said first portion of said tool includes an electrical connector insertable in and frictionally engageable with said electrical socket permitting the transmission of electrical energy from said support to said tool.

19. Apparatus as set forth in claim 18 wherein said electrical connector is connected with said recessed portion of said tool and is frictionally engageable with said electrical socket when said recessed portion of said tool is surrounding said upstanding post.

20. Apparatus as set forth in claim 15 wherein said support comprises a frame having a lower part and an upper part, said post having wall means extending upward from the lower part of said frame, said lever being biased to a position in which its first end is disposed at the lower part of said post and said lever being pivotal in a direction that moves its first end in an upward direction relative to the lower part of said post to exert said prying force against the portion of the hand tool surrounding said upstanding wall means of said post.

21. A support as set forth in claim 20 wherein said lever includes a substantially planar top surface, said first end of said lever including an integral member extending upward from said top surface and adapted to engage the portion of the hand tool surrounding said upstanding wall means of said post to exert said prying force thereagainst.

22. A support as set forth in claim 21 wherein said frame has wall portions that extend angularly upward from the lower part of the frame to the upper part, and said lever extends angularly upward from its first end to its second end, said lever being biased to a position in which its top surface is substantially coplanar with the upper wall portions of said frame, said second end of said lever being pivotal downward relative to the upper part of the frame to pivot the first end of the lever upward relative to the post to exert the prying force on said portion of said hand tool surrounding said wall means of said post.

23. A support as set forth in claim 22 further including trough means to collect products of discharge from a hand tool engaged with said support, said trough means being integral with said frame and being disposed below the upper part of the frame and forwardly of the upper part of the frame.

24. A support as set forth in claim 23 wherein said frame comprises an integral molded piece of plastic, and said lever comprises an integral molded piece of plastic.

25. Apparatus as set forth in claim 14 wherein said support is adapted to rest on a surface, and said first portion of said tool comprises a handle adapted to extend at an acute angle to said surface when said tool is supported on said support, means on said handle for frictionally engaging said post, and the frictional engagement between said post and said handle enabling said handle to tilt on said post to allow said second portion of said tool to make said predetermined movement relative to said support, said second portion of said tool being fixedly connected with said handle and being adapted to engage said lever at an angle relative thereto to cause said lever to pivot when said second portion of said tool makes said predetermined movement relative to said support.

26. Apparatus as set forth in claim 25 wherein said lever is biased to extend at an acute angle to a support surface when said support rests on the support surface, and said handle extends at an acute angle to said lever when said tool is supported on said support.

27. Apparatus as set forth in claim 26 wherein said support is adapted to rest on a horizontal support surface and said handle and lever are disposed to extend angularly upward at acute angles relative to said horizontal support surface when said tool is supported on said support, said handle being further disposed to tilt in a manner that causes said second portion of said tool to apply a downward force to the upper end of the lever to pivot said lever to disengage said tool from said support.

28. Apparatus as set forth in claim 27 wherein said hand tool comprises an electrically energized tool, said post comprises a socket and said support includes means for electrically coupling said socket to a source of electricity, said handle having means for electrically coupling said tool with said socket, and said last mentioned means being detached from said socket when said handle is disengaged from said post.

29. Apparatus as set forth in claim 28 wherein said hand tool comprises a glue gun with a nozzle for dispensing liquid adhesive, said handle and said second portion of said tool cooperating to define a pair of lower supporting points which can support the glue gun from a surface with the nozzle disposed above the surface when the glue gun is released from said support.

30. Apparatus comprising an adhesive applicator and a support for releasably supporting said adhesive applicator, said adhesive applicator having means for dispensing an adhesive and electrically energized heating means for heating an adhesive, said support comprising an electrical socket and means for connecting said socket to a source of electricity, said adhesive applicator comprising a handle and coupling means for engaging said adhesive applicator with said support and for electrically coupling said heating means with said socket, and means for releasing said coupling means from engagement with said support and for uncoupling said heating means from said socket to enable said adhesive applicator to be separated from said support and from the source of electricity to apply adhesive to an object, said coupling means being connected with said handle, and said means for releasing including lever means in said support for exerting a prying force on said handle means for disengaging said coupling means for said support.

31. Apparatus as set forth in claim 30 wherein said support comprises an upstanding post with said electrical socket secured thereto, said handle having a recessed portion with wall means for surrounding said post and electrical connector means for electrically connecting said heating means with said socket.

32. Apparatus as set forth in claim 31 wherein said support is adapted to rest on a support surface, and said applicator includes force applying means for applying force to a selected portion of said lever to cause said lever to exert said prying force on said handle means.

33. Apparatus as set forth in claim 32 wherein said handle can rock on said post to initiate the movement of said force applying means that causes said lever to exert said prying force on said handle means.

34. Apparatus as set forth in claim 33 wherein said force applying means is fixedly connected with said handle and cooperates with said handle to define a pair of points for supporting said adhesive applicator from a surface with said dispensing means held above said surface.

* * * * *